United States Patent [19]

Quigley

[11] Patent Number: 4,749,178

[45] Date of Patent: Jun. 7, 1988

[54] BACKSTAND THREADING DEVICE FOR PAPER SHEETER

[75] Inventor: David Quigley, Shirley, Ill.

[73] Assignee: Union Camp Corporation, Wayne, N.J.

[21] Appl. No.: 948,320

[22] Filed: Dec. 31, 1986

[51] Int. Cl.[4] ..... B65H 29/46

[52] U.S. Cl. ..... 270/31; 212/206; 162/133; 226/91

[58] Field of Search ..... 270/30–31, 270/41; 226/49–51, 91, 158; 108/51.1, 52.1, 20, 21; 162/133, 86, 194, 269, 283, 286

[56] References Cited

U.S. PATENT DOCUMENTS

| | | | |
|---|---|---|---|
| 1,812,861 | 7/1931 | Chase | 108/51.1 |
| 3,090,495 | 4/1963 | Mutch | 212/206 |
| 3,503,605 | 3/1970 | Stumpf et al. | 226/91 X |
| 3,786,936 | 1/1974 | Staadt | 212/206 |
| 4,158,414 | 6/1979 | Wilson | 212/206 |
| 4,381,859 | 5/1983 | Jung et al. | 270/31 |
| 4,456,502 | 6/1984 | Bollani | 162/133 |
| 4,475,729 | 10/1984 | Costigan | 270/31 |
| 4,566,944 | 1/1986 | Mauranew et al. | 162/193 X |

*Primary Examiner*—E. H. Eickholt

*Attorney, Agent, or Firm*—Edward J. Sites

[57] ABSTRACT

A backstand threading device to be mounted on a paper sheeter to permit an operator to move the device and himself along the length of the paper sheeter to thread each of the plurality of webs moving through the paper sheeter.

7 Claims, 5 Drawing Sheets

BACKSTAND THREADING DEVICE FOR PAPER SHEETER

BACKGROUND OF THE INVENTION

1. Field Of The Invention

The invention relates to a backstand threading device for a paper sheeter and, more particularly, to a device which can be moved by an operator along the length of the paper sheeter so that the operator can thread any one of a plurality of webs, fed from a plurality of rolls mounted on backstands at the input end of the paper sheeter, through the paper sheeter to insure that the webs are superimposed and aligned when they reach the output end of the paper sheeter where the plurality of webs are cut into a stack of sheets.

2. Brief Description of the Prior Art

The threading device provides a means for the operator to thread the webs at the backstand without climbing on top of the paper sheeter which would be a violation of OSHA rules and presents some jeopardy to the operator attempting to thread the webs.

One manufacturer of a paper sheeter provides one solution to this problem by using what appears to be a hardware store ladder with wheels on the bottom and with the top fitting into a groove on the top sheeter rails, so that the operator can slide the ladder from point to point to rethread the backstand.

In the prior art U.S. Pat. Nos. 4,456,502, 4,591,503 and 4,566,944 show examples of backstand threading devices but none provide for an operator carriage or for operator support while hand threading.

U.S. Pat. Nos. 1,812,861 and 3,786,936 are examples of operator's cabs or cages which ride back and forth on traveling bridge cranes, which are only of general interest.

U.S. Pat. No. 3,090,495 is another example of an operator's cage generally on a traveling bridge crane.

None of the prior art discloses the device of the present invention.

SUMMARY OF THE INVENTION

The invention comprises a backstand threading device to be mounted on a paper sheeter in which a plurality of paper webs fed from rolls mounted on a plurality of backstands at the input end of the paper sheeter are threaded through the paper sheeter to superimpose and align the webs with each other, and moved to the ouput end of the paper sheeter where the plurality of webs are cut into stacks of sheets, the said device permitting the operator standing on the device to move the device along one side of the sheeter to permit the operator access to the longitudinal edges of the webs to thread the webs through the sheeter.

The present invention is a distinct improvement over the ladder and the like disclosed in the prior art. It comprises two platforms, one on either side of the device. Each platform is connected to a fold-down ladder. The device rides on wheels along a track on the top rails of the machine, with small wheels on the bottoms of the rails to keep the device from jumping the track. The device is propelled by handwheels connected through a chain and sprocket which allows the device to be moved in either direction by the operator merely by turning the handwheel on either side of the device. The device can also be moved electrically by pushing a button.

DETAILED DESCRIPTION OF THE PREFERRED EMBODIMENT

Figure 1:
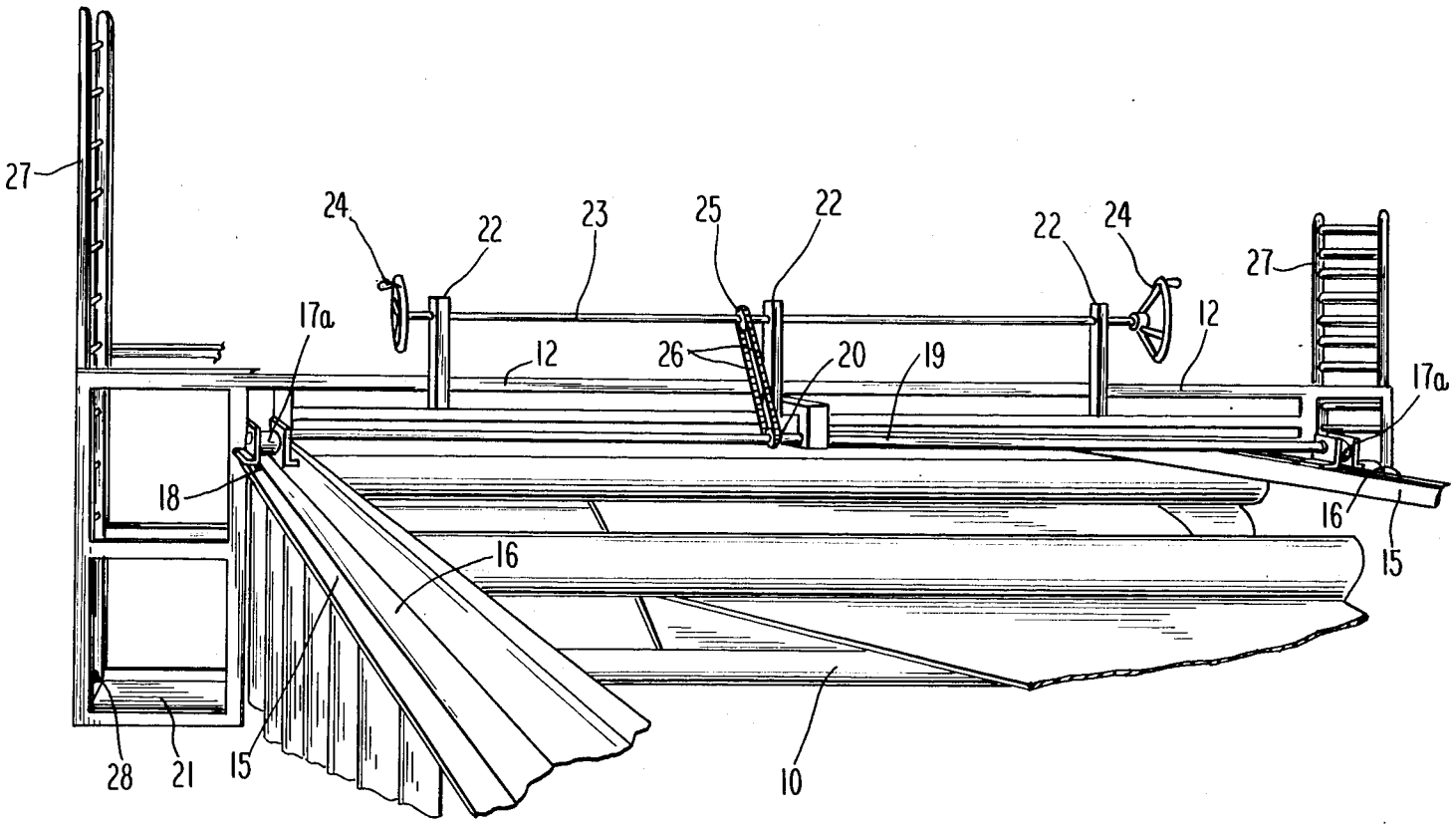
FIG. 1 is a perspective end view of the device of the present invention mounted on the top of the paper sheeter.

Referring to the drawings, there is shown in FIG. 1 a portion of the paper sheeter 10 on which the threading device of the present invention is mounted. This paper sheeter is a long sheeter with a plurality of backstands at the input end. These backstands hold rolls of paper from which the webs are threaded into a series of rollers mounted cross-wise of the paper sheeter. These rollers serve to superimpose and align the webs as they run through the sheeter to the output end, where a plurality of the webs is cut to provide a stack of sheets of paper.

The purpose of the threading device is to provide a means whereby an operator can grip the longitudinal edges of the webs and thread them through the paper sheeter without having to climb on top of the sheeter, which violates the OSHA rules and presents hazards to the operator. Since most sheeters are too wide for the operator to reach completely across the machine, the threading device should preferably provide access from both sides of the sheeter.

Figure 5:
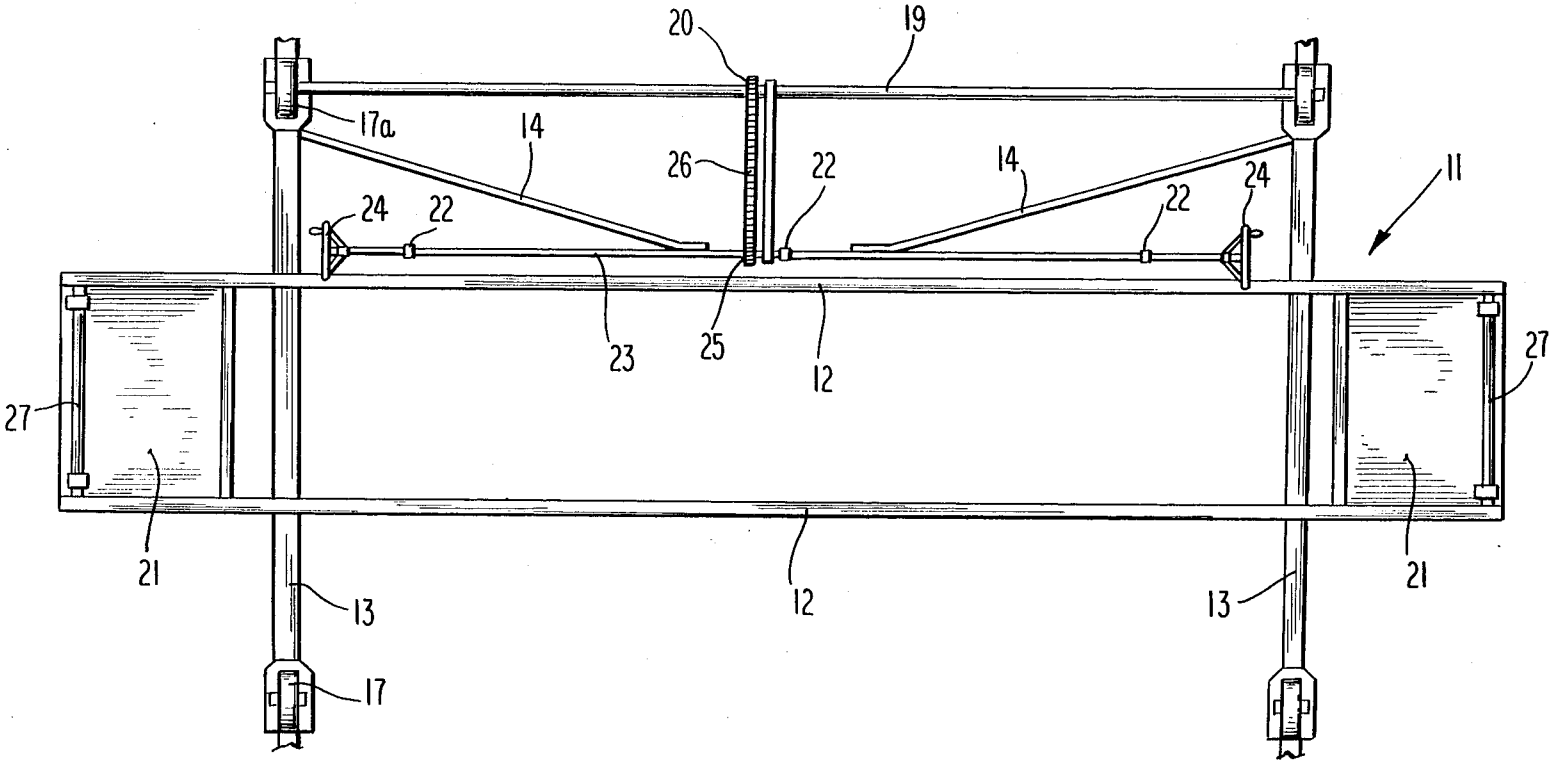
FIG. 5 is a plan top view of the device mounted on the top of the paper sheeter.

The threading device of the present invention, comprises, a frame 11 which is made up of a generally rectangular member 12 which extends crosswise of the sheeter and wheel supports 13 connected to the rectangular member. Cross members 14 serve as bracing for the members 12 and supports 13 (FIG. 5).

Figure 4:
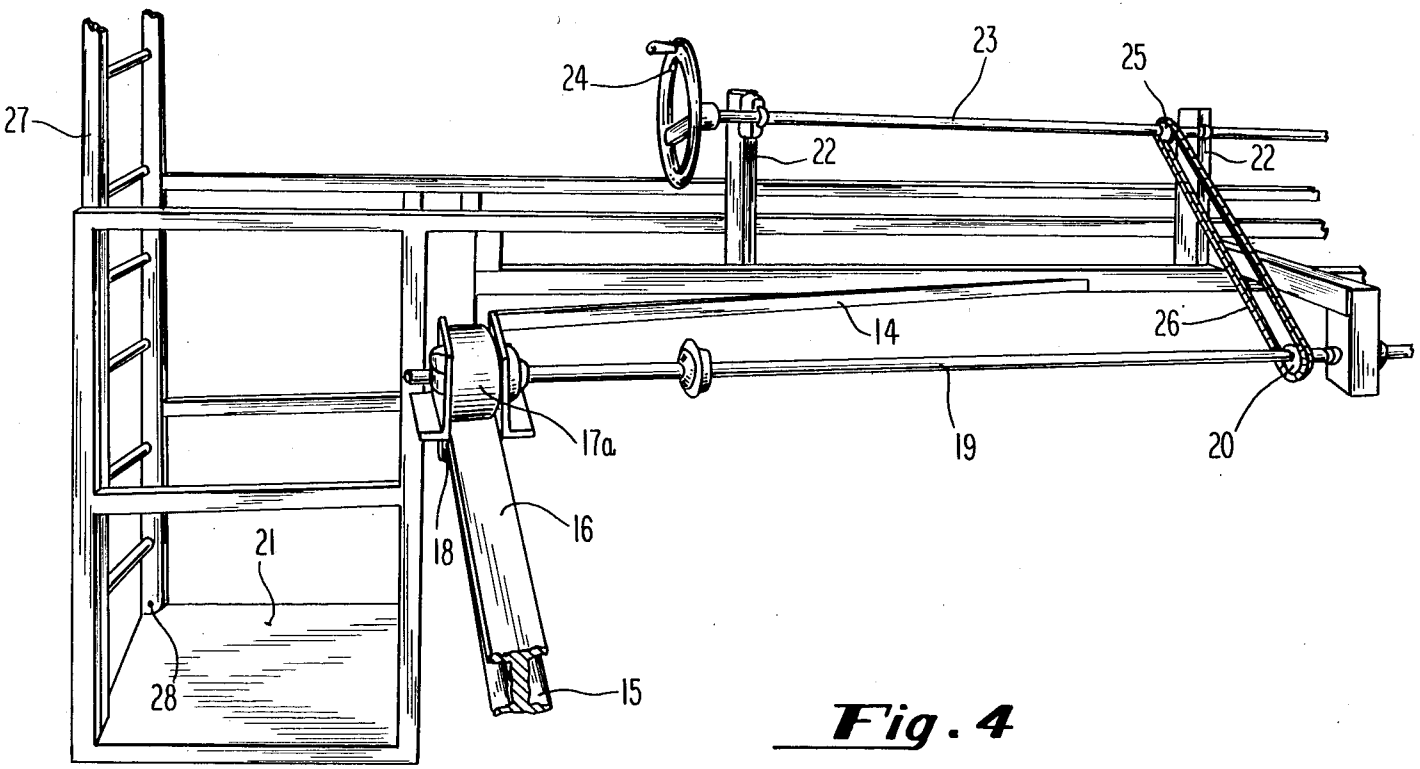
FIG. 4 is a perspective end view of one side of the device showing the mechanism for moving the device along the paper sheeter.

The top of the paper sheeter has a pair of parallel I beams 15 with one along each side of the paper sheeter and running the length of the paper sheeter. These will serve as a track 16 for moving the threading device along the length of the paper sheeter. Of course, it will be understood that a separate track can be placed in some other position along the length of the paper sheeter. (FIGS. 1 and 4)

Figure 2:
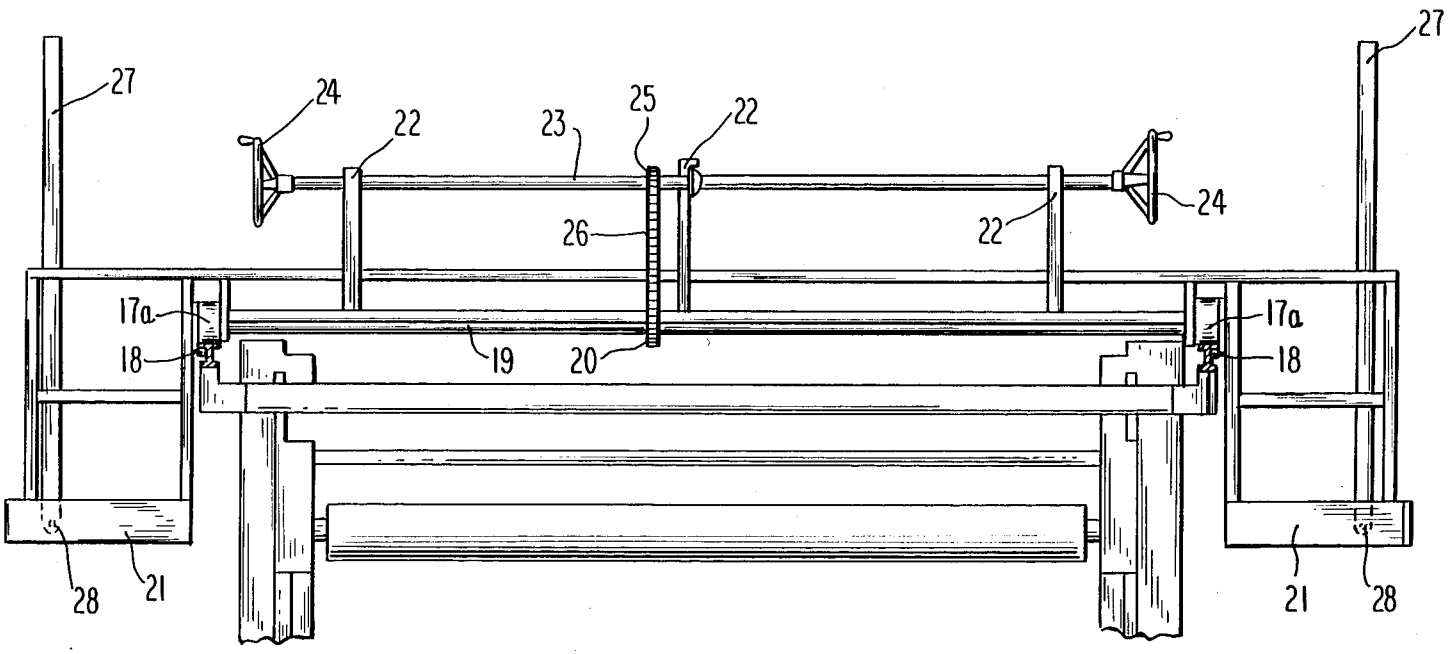
FIG. 2 is a plan end view of the device mounted on the top of the paper sheeter.
Figure 3:
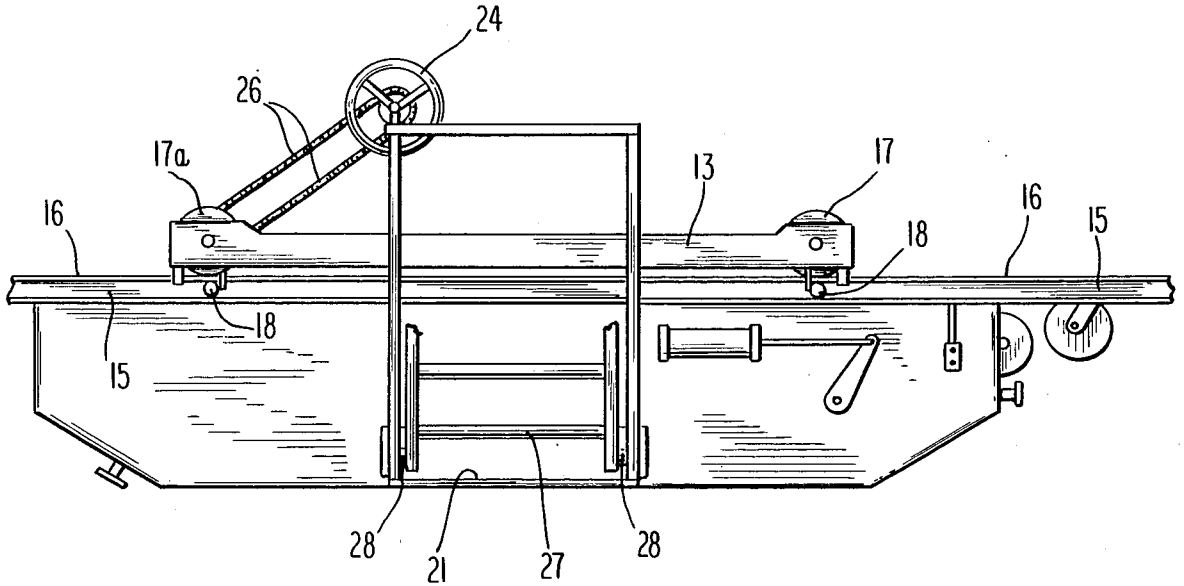
FIG. 3 is a plan side view of the device and a portion of the paper sheeter.

Mounted underneath the wheel supports 13 are wheels 17, one of which is a drive wheel (for example wheel 17*a*, FIG. 4), with the wheel supports spaced on the rectangular member 12 so that the wheels will ride along the track 16 (FIGS. 2 and 3). Small locking wheels 18 are mounted under the flange of the track to prevent the wheels 17 from jumping the track 16 (FIG. 3). As shown in the drawings the drive wheel 17*a* on one track and wheel 17 on the opposite are mounted on a shaft 19 running across the sheeter. Also mounted on the shaft 19 is a sprocket wheel 20.

At each end of the rectangular member 12 a platform 21 is secured to the member to support an operator to move with the device along each side of the sheeter to permit the operator access to adjacent longitudinal edges of the webs to thread the webs through the sheeter (FIG. 1). The preferred embodiment provides for a platform on each side of the paper sheeter since most sheeters are too wide for the operator to handle the webs from only one side of the sheeter. However, if the sheeter is narrow enough, a platform on only one side will suffice.

Projecting above the rectangular member 12 are a pair of vertical supports 22 through which pass a shaft 23 with each end adjacent the platform 21. Affixed to each end of the shaft 23 is a hand wheel 24 available for access by the operator on the platform. Mounted on the shaft 23 is a sprocket wheel 25. The sprocket wheels 20 and 24 are positioned to receive a sprocket chain 26 which meshes with the sprockets on the two wheels.

Thus, the operator from either platform can rotate the adjacent hand wheel and, through the sprocket chain drive means interconnected to the drive wheels, rotate the drive wheel and move the device along the path of the paper sheeter in either direction.

The hand wheels and sprocket drive can be eliminated by connecting an electric motor to drive wheel 17*a*. In such case a switch to activate the motor can be located adjacent each platform 21 so that the operator moves the device with electric power rather than manually. This can be a reversible electric motor or a motor provided with a reversing mechanism so that the device can be moved in either direction along the length of the paper sheeter.

Since the paper sheeter is high and the operator must reach the platform, a fold-down or slide-down ladder can be attached to the platform to permit the operator to climb easily to the platform without using separate ladder means. In FIG. 4 a form of fold-down ladder is shown. The ladder can be easily folded downward for use as a ladder or folded upward as part of a cab or cage for the platform.

Those skilled in the art will appreciate that many variations of the above described embodiment of the invention may be made without departing from the spirit and scope of the invention.

What is claimed is:

1. A backstand threading device for a paper sheeter in which a plurality of paper webs fed from rolls mounted on a plurality of backstands at the input end of the sheeter are threaded through the sheeter to superimpose and align the webs with each other, and moved to the output end of the paper sheeter where the plurality of webs are cut into stacks of sheets, the said device comprising:

a frame having a member extending cross-wise of the paper sheeter a track mounted lengthwise along the top of the paper sheeter for moving the threading device along the length of the paper sheeter;

wheels, at least one of which is a drive wheel, mounted on the base of the threading device and positioned to ride along the said track;

a platform secured to the frame to support an operator, the said platform being positioned to move with the device along one side of the paper sheeter to permit the operator access to the adjacent longitudinal edges of the webs to thread the webs through the paper sheeter;

drive means interconnected to the drive wheel to rotate the wheel and move the device in either direction along the said track; and means within reach of the operator on the platform to actuate the drive means;

whereby the operator on the platform can move the threading device to any position along the paper sheeter to thread the webs through the paper sheeter.

2. The backstand threading device of claim 1 in which there is a platform on each side of the frame positioned for the operator on the platform to have access to the adjacent longitudinal edges of the web on either side of the paper sheeter.

3. The backstand threading device of claim 1 in which the drive means comprises a shaft and a hand wheel accessible to the operator whereby the operator can manually actuate the hand wheel and rotate the drive wheel.

4. The backstand threading device of claim 1 in which the drive means is an electric motor with a reversing means and the actuating means is a switch to actuate the motor.

5. The backstand threading device of claim 2 in which the drive means comprises a shaft running across the paper sheeter with a hand wheel at each end accessible to the operator from either platform, whereby the operator can manually actuate the hand wheel from his platform and rotate the drive wheel.

6. The backstand threading device of claim 1 in which there is a ladder attached to the platform for the operator to reach the platform from the base of the paper sheeter.

7. The backstand threading device of claim 1 in which the track is provided with a flange and the device comprises locking wheels which ride under such flange to prevent the device from jumping the track.

* * * * *